US005993576A

United States Patent [19]

Ichinose et al.

[11] Patent Number: 5,993,576

[45] Date of Patent: Nov. 30, 1999

[54] WEAR RESISTANT WROUGHT ALUMINUM ALLOY AND SCROLL OF WEAR-RESISTANT WROUGHT ALUMINUM ALLOY

[75] Inventors: Akira Ichinose, Oyama; Akira Hideno, Koga; Nobuaki Ohara, Oyama, all of Japan

[73] Assignee: The Furukawa Electric Co., Ltd., Tokyo, Japan

[21] Appl. No.: 08/790,949

[22] Filed: Jan. 29, 1997

Related U.S. Application Data

[63] Continuation-in-part of application No. 08/755,976, Nov. 25, 1996, abandoned.

[30] Foreign Application Priority Data

| | | | |
|---|---|---|---|
| Nov. 29, 1995 | [JP] | Japan | 7-310429 |
| Sep. 30, 1996 | [JP] | Japan | 8-278763 |

[51] Int. Cl.[6] ..... C22C 21/02

[52] U.S. Cl. ..... 148/690; 420/534; 420/535; 420/532; 148/439

[58] Field of Search ..... 420/534, 535, 420/532; 148/439, 690

[56] References Cited

U.S. PATENT DOCUMENTS

| | | | |
|---|---|---|---|
| 4,908,077 | 3/1990 | Nakamura et al. | 148/437 |
| 5,123,973 | 6/1992 | Scott et al. | 148/690 |
| 5,388,973 | 2/1995 | Richardson, Jr. | 418/55.2 |

FOREIGN PATENT DOCUMENTS

| | | | |
|---|---|---|---|
| 508426 A2 | 10/1992 | European Pat. Off. | C22C 1/04 |
| 08028493 | of 1994 | Japan | C22F 1/43 |
| 7-34169 | 2/1995 | Japan | C22C 21/02 |
| 7-197164 | 8/1995 | Japan | C22C 21/02 |
| 8-28493 | 1/1996 | Japan | F04D 29/30 |

*Primary Examiner*—Samuel M. Heinrich
*Assistant Examiner*—M. Alexandra Elve
*Attorney, Agent, or Firm*—Frishauf, Holtz, Goodman, Langer & Chick, P.C.

[57] ABSTRACT

A wear-resistant wrought Al alloy having a desirable high fatigue strength, toughness and flexure strength when subjected to a quenching and an age hardening heat treatment. The Al alloy contains 8.0 to 13.0% by weight of Si, 0.1 to 0.5% by weight of Fe, 1.5 to 5.0% by weight of Cu, 0.4 to 1.5% by weight of Mg, 0.05 to 0.5% by weight of Cr, 0.05 to 0.5% by weight of Ni, an element selected from the group consisting of 0.005 to 0.05% by weight of Sr and 0.05 to 0.3% by weight of Sb, and the remainder being Al and unavoidable impurities, wherein there is no more than 0.04% by weight of Mn as an unavoidable impurity. The Al alloy having Si particles being finely dispersed therein, wherein an average diameter of an equivalent circle of Si particles is not more than 5.00 $\mu$m and an average roundness of Si particles is not less than 0.50. The amounts of Fe, Cr and Ni contained in the alloy and the amount of Mn as an impurity are such to prevent Si particles and other intermetallic compounds from enlarging. At the same time, with the above amounts of Sr or Sb, it is possible to reduce the size of the Si particles and to control the shape. Thus the occurrence or propagation of cracking, which is caused by Si particles can be delayed. The Al alloy exhibits the characteristics necessary for a scroll compressor.

12 Claims, 2 Drawing Sheets

SHAPE 1

SHAPE 2

SHAPE 3

SHAPE 4

(X400)

(X400)

WEAR RESISTANT WROUGHT ALUMINUM ALLOY AND SCROLL OF WEAR-RESISTANT WROUGHT ALUMINUM ALLOY

CROSS-REFERENCE TO THE RELATED APPLICATIONS

This application is a continuation-in-part of U.S. patent application Ser. No. 08/755,976, filed Nov. 25, 1996, now abandoned, the entire contents of which are incorporated herein by reference.

BACKGROUND OF THE INVENTION

The present invention relates to a wear-resistant wrought Al alloy and it's production, and a scroll of the wear-resistant wrought Al alloy formed by forging and it's production.

More particularly, it relates to a wear-resistant wrought Al alloy which is used for a compressor for air-conditioner and automotive parts (e.g. piston, valve lifter or rocker arm for an engine) and it's production, that is, an Al alloy which has excellent fatigue strength at high temperature, high toughness and high flexure strength, in addition to high strength and high wear resistance required for materials, and it's production.

Extruded Al—Si (4032) alloy (Al-12 wt % Si-1.0 wt % Mg-1.0 wt % Ni alloy), ASTM 336.0 casting alloy (Al-12 wt % Si-1.0 wt % Mg-1.0 wt % Cu-1.0 wt % Cu alloy), ASTM 383.0 die-cast alloy (Al-11 wt % Si-2.5 wt % Cu alloy), etc. have hitherto been used for automotive parts, electric appliances, mechanical parts, etc., for which high strength and high wear resistance are required.

There has recently been increasing a case of using those obtained by (hot or cold) forging extruded materials or casting bar materials of aluminum alloys for these parts so as to make dimensional accuracy and strength high and to perform weight-saving.

On the other hand, with the increase of a demand for aluminum alloys, a required quality has been changing and becoming higher. For example, an improvement of high strength and high wear resistance as well as toughness and fatigue strength at high temperature is required for parts (e.g. scroll, wabble plate, etc.) used for a compressor for an air-conditioner.

Similarly, high strength and high wear resistance under a high-temperature environment (100 to 200° C.) are required for automotive parts of the engine part (e.g. piston, valve lifter, rocker arm, etc.) and materials whose fatigue strength and toughness at high temperature are high are required.

However, in a conventional extruded aluminum alloy or aluminum casting alloy bar having the above composition, there has never been obtained a material having high fatigue strength and high toughness at high temperature in addition to high strength and high wear resistance.

An Al alloy extruded material obtained by adding a small amount of Fe, Mn, Cr, Sr and Ti to an Al-6–15 wt % Si—Cu—Mg—Ni alloy has been suggested for this application (e.g. Japanese Patent Application Laid-Open No. 7-197164/1995), however, it has not various characteristics and has a problem that high-temperature fatigue strength and toughness are inferior.

Furthermore, the form of the part as these sliding members has been complicated and a flexure strength represented by a compressor scroll has been required in addition to the above characteristics. Heretofore, a material which is superior in high-temperature fatigue strength, toughness and flexure strength has never been present.

BRIEF SUMMARY OF THE INVENTION

It is an object of the present invention to provide an Al alloy which has high-temperature fatigue strength, excellent toughness and high flexure strength, in addition to high strength and high wear resistance, and it's production. Specifically, it is an object of the present invention to improve the fatigue strength at high temperature, toughness and flexure strength, in addition to high strength and high wear resistance, in a hypo-eutectic or eutectic Al—Si alloy having high strength and high wear resistance, which is used for automotive parts, electric appliances, mechanical parts, etc., thereby providing the Al—Si alloy material having all these improved characteristics, a scroll of an Al alloy and their production.

This object is accomplished by the following Al—Si alloy material, scroll of the Al alloy and their production.

That is, the present invention provides a wear-resistant wrought Al alloy having excellent high fatigue strength, toughness and flexure strength in the state of being subjected to a quench and age hardening heat treatment, comprising 8.0 to 13.0% by weight of Si, 0.1 to 0.5% by weight of Fe, 1.0 to 5.0% by weight of Cu, 0.4 to 1.5% by weight of Mg, 0.05 to 0.5% by weight of Cr, 0.05 to 0.5% by weight of Ni, any one selected from the group consisting of 0.005 to 0.05% by weight of Sr and 0.05 to 0.3% by weight of Sb, and the remainder of Al and an unavoidable impurity, an amount of Mn as the unavoidable impurity being controlled to not more than 0.04% by weight, the Al alloy in which Si particles are finely dispersed, wherein an average diameter of an equivalent circle of Si particles is not more than 5.00 $\mu$m and an average roundness of Si particles is not less than 0.50.

The present invention also provide a wear-resistant wrought Al alloy having excellent high fatigue strength, toughness and flexure strength in the state of being subjected to a quench and age hardening heat treatment, comprising 8.0 to 13.0% by weight of Si, 0.1 to 0.5% by weight of Fe, 1.0 to 5.0% by weight of Cu, 0.4 to 1.5% by weight of Mg, 0.05 to 0.5% by weight of Cr, 0.05 to 0.5% by weight of Ni, not more than 0.25% by weight of Zn, any one selected from the group consisting of 0.005 to 0.05% by weight of Sr and 0.05 to 0.3% by weight of Sb, and the remainder of Al and an unavoidable impurity, an amount of Mn as the unavoidable impurity being controlled to not more than 0.04% by weight, the Al alloy in which Si particles are finely dispersed, wherein an average diameter of an equivalent circle of Si particles is not more than 5.00 $\mu$m and an average roundness of Si particles is not less than 0.50.

The present invention also provide a wear-resistant wrought Al alloy having excellent high fatigue strength, toughness and flexure strength in the state of being subjected to a quench and age hardening heat treatment, comprising 8.0 to 13.0% by weight of Si, 0.1 to 0.5% by weight of Fe, 1.0 to 5.0% by weight of Cu, 0.4 to 1.5% by weight of Mg, 0.05 to 0.5% by weight of Cr, 0.05 to 0.5% by weight of Ni, any one selected from the group consisting of 0.005 to 0.05% by weight of Sr and 0.05 to 0.3% by weight of Sb, at least one selected from the group consisting of not more than 0.1% by weight of Ti and 0.05% by weight of B, and the remainder of Al and an unavoidable impurity, an amount of Mn as the unavoidable impurity being controlled to not more than 0.04% by weight, the Al alloy in which Si particles are finely dispersed, wherein an average diameter of an equivalent circle of Si particles is not more than 5.00 $\mu$m and an average roundness of Si particles is not less than 0.50.

The present invention also provide a wear-resistant wrought Al alloy having excellent high fatigue strength, toughness and flexure strength in the state of being subjected to a quench and age hardening heat treatment, comprising 8.0 to 13.0% by weight of Si, 0.1 to 0.5% by weight of Fe, 1.0 to 5.0% by weight of Cu, 0.4 to 1.5% by weight of Mg, 0.05 to 0.5% by weight of Cr, 0.05 to 0.5% by weight of Ni, not more than 0.25% by weight of Zn, any one selected from the group consisting of 0.005 to 0.05% by weight of Sr and 0.05 to 0.3% by weight of Sb, at least one selected from the group consisting of not more than 0.1% by weight of Ti and 0.05% by weight of B, and the remainder of Al and an unavoidable impurity, an amount of Mn as the unavoidable impurity being controlled to not more than 0.04% by weight, the Al alloy in which Si particles are finely dispersed, wherein an average diameter of an equivalent circle of Si particles is not more than 5.00 $\mu$m and an average roundness of Si particles is not less than 0.50.

The present invention also provide a process for producing any one of the above wear-resistant wrought Al alloys, which comprises subjecting an Al alloy ingot to a homogenizing heat treatment at 480 to 540° C. for not less than 2 hours; hot-extruding or hot-rolling the Al alloy ingot for conversion into an Al alloy ingot in which Si particles are finely dispersed, wherein an average diameter of an equivalent circle of Si particles is not more than 5.00 $\mu$m and an average roundness of Si particles is not less than 0.50; forging the Al alloy ingot, followed by maintaining at 490 to 520° C. for 30 minutes to 4 hours and further water quenching; and subjecting the resultant to a quench and age hardening heat treatment of conducting an artificial aging treatment at 170 to 190° C. for 4 to 16 hours.

The present invention also provide a scroll of any one of the above wear-resistant wrought Al alloys, which is obtained by forming due to forging and subjecting to a quench and age hardening heat treatment.

The present invention also provide a scroll of the above wear-resistant wrought Al alloy, wherein the forming due to forging is performed by forging an ingot one or more times under the condition of a forging die temperature of 120 to 170° C., a material temperature of 220 to 370° C. and a ram descending velocity of 200 to 800 mm/sec, using a cold forging lubricant containing $MoS_2$.

The present invention further provide a process for producing a scroll of a wear-resistant wrought Al alloy which is superior in dimensional accuracy after forging, which comprises subjecting an Al alloy ingot to a homogenizing heat treatment at 480 to 540° C. for not less than 2 hours; hot-extruding or hot-rolling the Al alloy ingot for conversion into an Al alloy ingot in which Si particles are finely dispersed, wherein an average diameter of an equivalent circle of Si particles is not more than 5.00 $\mu$m and an average roundness of Si particles is not less than 0.50; forming by forging one or more times under the condition of a forging die temperature of 120 to 170° C., a material temperature of 220 to 370° C. and a ram descending velocity of 200 to 800 mm/sec, using a cold forging lubricant containing $MoS_2$; maintaining the Al alloy ingot at 490 to 520° C. for 30 minutes to 4 hours, followed by water quenching; and subjecting the resultant to a quench and age hardening heat treatment of conducting an artificial aging treatment at 170 to 190° C. for 4 to 16 hours.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1A:
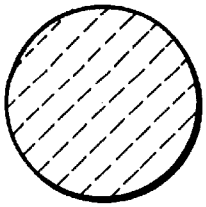
FIG. 1A to FIG. 1D are schematic diagrams illustrating the form of Si particles in the metallic structure of the Al alloy.

The present invention will be explained in detail.

Firstly, the reason of the limitation on the alloy composition will be explained.

Si is crystallized to form a hard eutectic Si in the matrix of the aluminum alloy and mainly improves the wear resistance and decreases the thermal expansion coefficient. The reason why an amount of Si contained is limited within the range from 8.0 to 13.0% by weight is as follows. That is, when the amount is less than 8.0% by weight, the effect is insufficient. On the other hand, when the amount exceeds 13.0% by weight, a coarse hypo-eutectic Si is formed and the toughness and fatigue at high temperature are drastically deteriorated. The amount of Si is preferably within the range from 10.0 to 12.0% by weight.

Cu imparts the tensile strength and wear resistance to the aluminum alloy. The reason why an amount of Cu contained is limited within the range from 1.0 to 5.0% by weight is as follows. That is, when the amount is less than 1.0% by weight, the effect is insufficient. On the other hand, when the amount exceeds 5.0% by weight, the forgeability is drastically deteriorated and, further, the corrosion resistance is also deteriorated and stress corrosion cracking arises easily. The amount of Cu is preferably within the range from 2.0 to 4.0% by weight.

Mg forms a $Mg_2Si$ precipitate to impart the strength. The reason why an amount of Mg contained is limited within the range from 0.4 to 1.5% by weight is as follows. That is, when the amount is less than 0.5% by weight, the effect is insufficient. On the other hand, when the amount exceeds 1.5% by weight, the elongation is lowered and, therefore, the forgeability and high-temperature fatigue strength are deteriorated. The amount of Mg is preferably within the range from 0.5 to 1.2% by weight.

Cr improves the wear resistance. The reason why an amount of Cr contained is limited within the range from 0.05 to 0.5% by weight is as follows. That is, when the amount is less than 0.05% by weight, the effect is insufficient. On the other hand, when the amount exceeds 0.5% by weight, a coarse compound is formed and, therefore, the fatigue strength at high temperature is deteriorated. The amount of Cr is preferably within the range from 0.05 to 0.3% by weight.

Fe has an action of increasing the hardness of the aluminum alloy and the wear resistance of the aluminum alloy is improved by containing Fe. The reason why an amount of Si contained is limited within the range from 0.1 to 0.5% by weight is as follows. That is, when the amount is less than 0.1% by weight, the effect is insufficient. On the other hand, when the amount exceeds 0.5% by weight, a large crystal is formed and, therefore, the fatigue strength at high temperature is deteriorated.

Ni improves the heat resistance and high-temperature fatigue strength. The reason why an amount of Cr contained is limited within the range from 0.05 to 0.5% by weight is as follows. That is, when the amount is less than 0.05% by weight, the effect is insufficient. On the other hand, when the amount exceeds 0.5% by weight, not only the effect is saturated but also a coarse compound such as $Al_3Ni$ is formed and, therefore, the fatigue strength at high temperature is deteriorated. The amount of Ni is preferably within the range from 0.2 to 0.3% by weight.

Sr is added on casting and refines a hypo-eutectic Si and an eutectic Si when the alloy is solidified, thereby improving the wear resistance, strength, toughness and forgeability. The reason why an amount of Sr contained is limited within the range from 0.005 to 0.05% by weight is as follows. That is, when the amount is less than 0.005% by weight, the effect is insufficient. On the other hand, when the amount exceeds 0.05% by weight, the effect is saturated and the cost becomes high in vain. The amount of Sr is preferably within the range from 0.01 to 0.03% by weight.

In the same way as Sr, Sb is also added on casting and refines a hypo-eutectic Si and an eutectic Si when the alloy is solidified, thereby improving the wear resistance, strength, toughness and forgeability. The reason why an amount of Sb contained is limited within the range from 0.05 to 0.3% by weight is as follows. That is, when the amount is less than 0.05% by weight, the effect is insufficient. On the other hand, when the amount exceeds 0.3% by weight, the effect is saturated and the cost becomes high in vain. The amount of Sb is preferably within the range from 0.1 to 0.2% by weight. Sr and Sb may be simultaneously added, but the effect is the same as that in case of adding alone. Therefore, 0.005 to 0.5% by weight of Sr or 0.05 to 0.3% by weight of Sb is added alone.

Zn has an action of increasing the hardness of the aluminum alloy and the wear resistance is improved by containing Zn. The reason why an amount of Zn contained is limited to not more than 0.25% by weight is as follows. That is, when the amount exceeds 0.25% by weight, the forgeability is deteriorated and, further, the corrosion resistance is deteriorated and stress corrosion cracking arises easily. The amount of Zn is preferably not more than 0.15% by weight.

Ti refines grains of the matrix of the aluminum alloy of the present invention. The reason why an amount of Ti contained is limited to not more than 0.1% by weight is as follows. That is, when the amount exceeds 0.1% by weight, the effect is saturated and, at the same time, a coarse intermetallic compound is formed to deteriorate the high-temperature fatigue strength. The amount of Ti is preferably not more than 0.08% by weight.

In the same way as Ti, B refines grains. The reason why an amount of B contained is limited to not more than 0.05% by weight is as follows. That is, when the amount exceeds 0.05% by weight, the effect is saturated and, at the same time, $AlB_2$ as a coarse intermetallic compound is crystallized to deteriorated the high-temperature fatigue strength. The amount of B is preferably not more than 0.01% by weight.

Then, not more than 0.1% by weight of Ti or not more than 0.05% by weight of B is contained alone, or not more than 0.1% by weight of Ti and not more than 0.05% by weight of B are contained in combination.

It is necessary to control an amount of Mn as the impurity to not more than 0.04% by weight. The reason is as follows. That is, Mn spheroidizes a hypo-eutectic Si and an eutectic Si and, at the same time, controlling the amount of Mn prevents coarsening of Si particle to improve the fatigue strength at high temperature and toughness. When the amount of Mn exceeds 0.4% by weight, formation and coarsening of the hypo-eutectic Si and coarsening of the eutectic Si arise and, at the same time, an Al—Fe—Si—Mn coarse intermetallic compound is formed to drastically deteriorate the fatigue strength at high temperature and toughness and increase scattering. It is preferred to control the amount of Mn to not more than 0.02% by weight.

Next, the dispersion state of Si particles in the present invention will be explained. It is a feature of the present invention that not only the particle size but also the form (roundness) of Si particles are controlled. The term "roundness of Si particles" means a degree of circle and is a parameter which represents an average degree of circle of particles in case of round being 1.

These are determined by image analysis of a metallurgical photograph as follows.

A photomicrograph of the structure of the test material taken by a metallurgical microscope (×400) is image-analyzed by using an image analyzing system, and then the size and form of Si particles are determined. Regarding the size of Si particles, the surface area of Si particles is substituted with a circle having the same area by using image analysis, and then the average diameter of the equivalent circle, wherein the average Si particle size is represented by the diameter of the circle, is determined by the following equation:

$$\text{average diameter of an equivalent circle } (\mu\text{m}) = 2 \Big/ \sqrt{(\text{area}/\pi)}\,.$$

Regarding the form of Si particles, the average roundness which represents a degree of the circle in case of round being 1 by image analysis is determined by the following equation:

$$\text{Average roundness}=4(\pi)(\text{area}/(\text{perimeter})^2)$$

The roundness of Si particles is shown in FIG. 1. This illustrates the form of Si particles dispersed in the metallic structure of the wear-resistant wrought Al alloy of the present invention and represents a roundness.

Figure 1B:
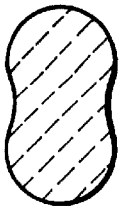
Figure 1C:
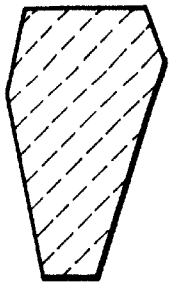
Figure 1D:
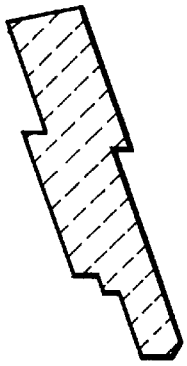

The form 1 shown in FIG. 1A illustrates generally round Si particles and the roundness is 1.00. The roundness of Si particles having the form 2 shown in FIG. 1B is 0.78. The roundness of Si particles having the form 3 shown in FIG. 1C is 0.50. Si particles having the form 4 shown in FIG. 1D has a needle form and the average roundness is 0.36. The sentence "the average roundness of Si particles is not less than 0.50" means that the average of roundness of Si particles having various forms is not less than 0.50.

As described above, the size (diameter of equivalent circle) and form (roundness) of Si particles dispersed in the metallic structure in the present invention are not more than 5.00 $\mu$m and not less than 0.50, respectively. That is, the reason why the particle size (diameter of equivalent circle) and form (roundness) are simultaneously controlled by the addition of Sb, control of the amount of Mn, homogenizing and selection of the extrusion conditions is as follows. Even if the size (diameter of equivalent circle) of Si particles is controlled to not more than 5.00 μm, a crack arises at the interface between the Si particles and matrix when the form is angular and, therefore, the fatigue strength at high temperature and toughness are deteriorated. Regarding those wherein the size and form of Si particles are not within the above range, the fatigue strength, toughness and flexure strength are deteriorated. The diameter of the equivalent circle and roundness of Si particles are preferably not more than 3.00 μm and not less than 0.50, respectively.

Figure 2A:
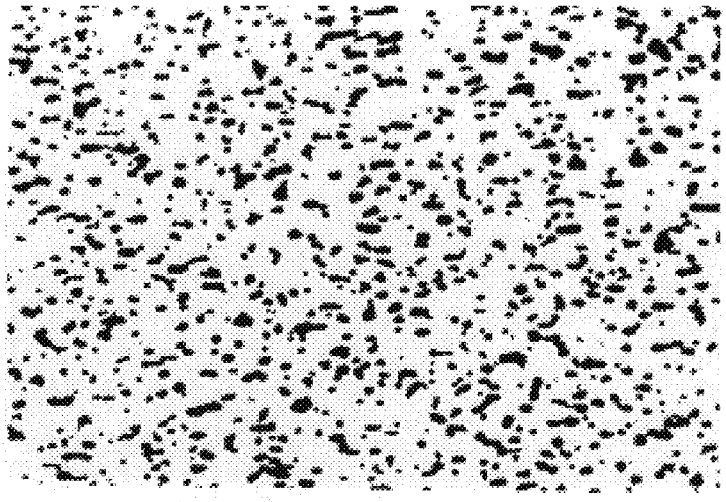
FIG. 2A is a photomicrograph (×400) illustrating the distribution (size, form) of Si particles in the metallic structure of the Al alloy in the present invention.
Figure 2B:
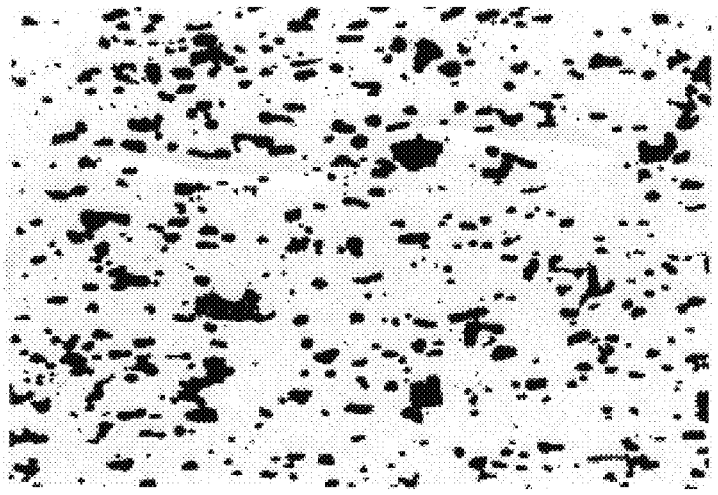
FIG. 2B is a photomicrograph (×400) illustrating the distribution (size, form) of Si particles in the metallic structure of a conventional Al alloy.

FIG. 2A and FIG. 2B are photomicrographs (×400) illustrating the distribution (size, form) of Si particles in the metallic structure of the Al—Si alloy material. FIG. 2A illustrates those of the present invention (Example No. 1 of the present invention shown in Table 1) and the amount of Mn is 0.01% by weight, and the diameter of the equivalent circle is 2.85 μm and the roundness is 0.62. Therefore, it is apparent that Si particles are fine and round. FIG. 2B illustrates a conventional one (Comparative Example No. 21 shown in Table 3) and the amount of Mn is 0.08% by weight, the diameter of the equivalent circle is 3.91 μm and the roundness is 0.35. Therefore, it is apparent that the diameter of the equivalent circle satisfies the range of the present invention (not more than 5.00 μm) but the roundness does not satisfies the range of the present invention and Si particles are slightly large and rectangular.

The diameter of the equivalent circle and roundness of Si particles of the Al—Si alloy of the present invention exclusively vary depending on the alloy composition (control of the positive addition of Sr or Sb and addition of Mn), homogenizing heat treatment conditions of ingot billet and hot extrusion, however, they scarcely vary depending on the following forging and heat treatment.

The present invention provides a material obtained by hot-extruding a material, wherein the alloy composition and dispersion (diameter of equivalent circle, roundness) of Si particles in the metallic structure are controlled, forming into a predetermined form due to forging, and finally subjecting to a quench and age hardening heat treatment (T6 material obtained by subjecting to an artificial age hardening treatment after subjecting to a solution treatment). The material subjected to such a heat treatment has high strength and high wear resistance and is superior in fatigue strength at high temperature, toughness and flexure strength.

Next, the process of producing the wear-resistant wrought Al alloy will be explained.

That is, according to the present invention, the Al alloy ingot billet having the above composition is subjected to a homogenizing heat treatment at 480 to 540° C. for not less than 2 hours, and then hot-extruded to convert into an Al alloy ingot billet wherein the diameter of the equivalent circle of Si particles in the metallic structure is not more than 5.00 μm and an average roundness of Si particles is not less than 0.50. After forging, the resultant is subjected to a quench and age hardening heat treatment (T6 treatment, artificial age hardening treatment after solution treatment).

The homogenizing heat treatment is conducted at 480 to 540° C. for not less than 2 hours so as to disperse micro segregation of the ingot and to dissolve a precipitate of elements added, and to refine and spherodize platelet or needle crystals of Si. When the temperature is lower than 480° C. and the time is short, the effect is not obtained and the above respective characteristics are not obtained. On the other hand, when the temperature is higher than 540° C., the ingot is likely to be molten. Accordingly, the homogenizing heat treatment of the ingot is conducted within the above range. The time may be long but it is uneconomical, and is preferably not more than 16 hours.

The reason why the hot extrusion is conducted after subjecting to the above heat treatment is as follows. That is, the eutectic Si of the ingot is divided, refined and then finely dispersed in the matrix, thereby converting into Si particles having the diameter of equivalent circle of not more than 5.00 μm and roundness of not less than 0.50. It is possible to form the same metallic structure by conducting hot rolling in place of hot extrusion.

The reason why the forging and quench and age hardening heat treatment (T6, artificial age hardening treatment after solution treatment) are conducted after the above hot extrusion is to further improve the respective characteristics in the state of use after forming into the predetermined form due to forging. In case of those having the alloy composition of the present invention, the fatigue strength at high temperature, toughness, flexure strength, strength and wear resistance are improved by maintaining at 490 to 520° C. for 30 minutes to 4 hours, followed by water quenching and further quench and age hardening heat treatment of conducting an artificial age hardening heat treatment at 170 to 190° C. for 4 to 16 hours.

The diameter of the equivalent circle and roundness of Si particles exclusively vary depending on the alloy composition (particularly, amount of Sr, Sb and Mn as an impurity is respectively controlled to not more than 0.04% by weight), homogenizing heat treatment condition of the alloy ingot billet and hot extrusion or hot rolling, and they do not vary depending on the following forging and heat treatment, thereby improving the fatigue strength at high temperature, toughness, flexure strength, strength, wear resistance and the like.

The present invention provides a wear-resistant wrought Al alloy having a specific alloy composition, wherein dispersion of Si particles of the metallic structure is specified, and has a feature that those obtained by forming due to forging and then subjecting to a quench and age hardening heat treatment have excellent fatigue strength at high temperature, toughness, flexure strength, strength, wear resistance and the like. It is preferably used after forming into a scroll.

It is formed by forging one one more times under the condition of a forging die temperature of 120 to 170° C., a material temperature of 220 to 370° C. and a ram descending velocity of 200 to 800 mm/second, using a cold forging lubricant containing $MoS_2$.

The forming of the Al alloy scroll having the alloy composition of the present invention due to forging will be explained.

The reason why the forging die temperature is limited within the range from 120 to 170° C. is as follows. That is, when the temperature is less than 120° C., a crack arises in the material and flow of the metal becomes inferior on forming due to forging in the forging die. On the other hand, when the temperature exceeds 170° C., the dimensional accuracy and surface quality of the resultant formed article become inferior.

The reason why the material temperature on forging is limited within the range from 220 to 370° C. is as follows. That is, when the material temperature is less than 220° C., the forging is not easily conducted. On the other hand, when the material temperature exceeds 370° C., the structure after forging is changed and the lubricating action of $MoS_2$ becomes insufficient.

The reason why the ram descending velocity is limited within the range from 200 to 800 mm/second is as follows. That is, when the velocity is less than 200 mm/second, the temperature of the material is reduced and the crack of the material arises easily on forging. On the other hand, when the velocity exceeds 800 mm/second, the temperature raises by heat generation due to material processing to change the structure after forging. The ram descending velocity is preferably within the range from 400 to 600 mm/second. The term "ram descending velocity" used herein means a processing rate of an upper die to a lower die as a forging die. The scroll has a spiral scroll part.

Forging of a scroll is usually performed from one to three times in the real process. In the present invention, however, the scroll can be formed by a single forging.

The reason why the scroll can be formed by even at least single forging in spite of the complicated form such as a spiral form is as follows. That is, when a material wherein Si particles are finely dispersed is formed under the above-described condition of the forging die temperature of 120 to 170° C., material temperature of 220 to 370° C. and ram descending velocity of 200 to 800 mm/second, using the cold forging lubricant containing $MoS_2$, a force is transmitted to the inside of the material in the forging die and a scroll having a complicated form can be obtained, thereby making it possible to obtain a scroll having no defects inside. It is sure that it can be adapted to perform forging more times to make more complicated form. As the cold forging lubricant containing $MoS_2$, those prepared by dispersing $MoS_2$ in oils and fats or mineral oils are used.

Since a scroll having no interior and surface defects as well as excellent dimensional accuracy after forging can be obtained by forming a wear-resistant wrought Al alloy having the alloy composition in the present invention, wherein controlling of Si particle dispersion and Si particle size in the metallic structure is specified, under the above-described forging condition. Therefore, a scroll of a ware-resistant wrought Al alloy, wherein a factor exerting an influence on the fatigue strength is removed, can be formed.

The step of subjecting an Al ingot to a homogenizing heat treatment at 480 to 540° C. for not less than 2 hours and then hot-extruding or hot-rolling the Al alloy ingot to convert into an Al alloy ingot in which Si particles are finely dispersed, wherein an average diameter of an equivalent circle of Si particles is not more than 5.00 $\mu$m and an average roundness of Si particles is not less than 0.50, and the step of subjecting the resultant to a quench and age hardening heat treatment of conducting an artificial aging treatment at 170 to 190° C. for 4 to 16 hours in the process of producing the Al alloy scroll having the alloy composition of the present invention are as described hereinabove.

Next, Examples which were carried out so as to make the effect of the present invention clear will be explained.

EXAMPLE 1

The first Example of the present invention will be explained with reference to Table 1 to Table 4.

Table 1 and Table 2 illustrate Examples of the present invention and evaluation results of mechanical characteristics of the quench and age hardened material (T6) are shown. Table 3 and Table 4 illustrate Comparative Examples and evaluation results of mechanical characteristics of the quench and age hardened material (T6) are shown.

In Table 1 to Table 4, an Al alloy ingot (diameter: 220 mm) having each alloy composition was produced by a semi-continuous casting process. This ingot billet was subjected to a homogenizing heat treatment under the condition of 480–520° C.×4–12 hours and then hot-extruded at the extrusion temperature of 420° C. to form an extruded bar having a diameter of 80 mm.

In order to evaluate mechanical properties, high-temperature fatigue strength, toughness and wear resistance, this extruded bar was quenched and then subjected to an artificial age hardening treatment to make a material subjected to a quench and age hardening heat treatment (T6 material, those obtained by subjecting to an artificial age hardening treatment after subjecting to a solution treatment).

A test material was made from the raw material thus obtained as described hereinafter, and the mechanical properties, high-temperature fatigue strength, wear resistance and flexure strength were determined by the following tests.

The testing methods are as follows.

(1) Mechanical Properties

A JIS No. 4 rod test piece was used as the test piece. Measuring items are tensile strength, proof stress and elongation.

(2) Toughness (Rupture Strength Characteristics)

A Charpy impact value was measured by using a test piece according to a Charpy impact test method.

(3) Wear Resistance Test

Using an Ohkoshi wear resistance testing machine, a specific wear of a test material was measured.

Lubricating condition: Gear oil (GL-5)

Wear distance: Wet type 200 mm

Load: 19.7 kg

Opposite material: SCM21

Wear rate: 3.62 m/second (4) High-temperature Fatigue Test

Using an Ono high-temperature rotary bending fatigue testing machine, a high-temperature fatigue strength of a test material was evaluated under the following condition.

Test temperature: 150° C.

Rotating rate: 3600 rpm

Repeating number: $1\times10^7$ (5) Flexure Test

Figure 3:
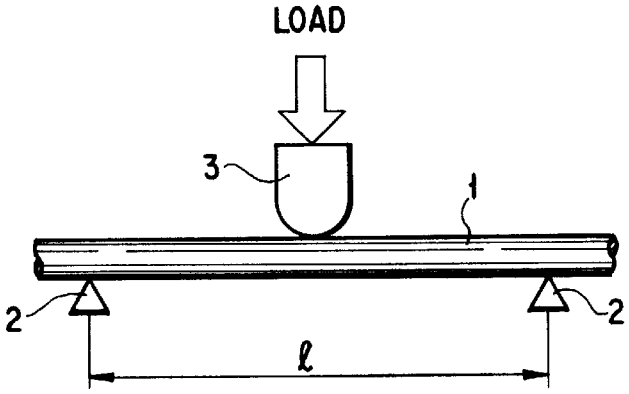
FIG. 3 is a schematic diagram illustrating the flexure test.

As shown in FIG. 3, a test piece (1) was placed on two supporting jigs (2) and a load was applied in the direction of the arrow, using a press jig (3), and then a flexure strength until the test piece (1) was ruptured and a stroke of the press jig (3) in the direction of the arrow until the test piece (1) was ruptured were measured, respectively. The test piece (1) has a length of 350 mm and a diameter of 20 mm, and a distance 1 between the supporting jigs (2) is 300 mm. This flexure test was conducted according to JIS Z2203 and a flexure test specimen was made according to JIS No. B.

A size (average diameter of equivalent circle) of Si particles of the metallic structure, wherein Si particles are finely dispersed,was measured with respect to a section structure obtained by cutting the above extrusion material in the direction which is parallel to the extrusion direction. Specifically, as described about FIG. 1 and FIG. 2 hereinabove, image analysis of a photomicrograph (×400) taken by using a metallurgical microscope was conducted by using an image analyzing system, and then the size and form of Si particles were measured. These results are shown in Table 1 to Table 4.

TABLE 1

Evaluation results of mechanical characteristics of quench and age hardened material (T6)

| Test material | No. | Chemical component (wt %) Si | Fe | Cu | Mg | Cr | Ni | Sr | Sb | Zn | Ti | B |
|---|---|---|---|---|---|---|---|---|---|---|---|---|
| Example No. of the present invention | 1 | 11.5 | 0.15 | 2.5 | 0.7 | 0.08 | 0.20 | 0.010 | — | — | — | — |
| | 2 | 9.3 | 0.30 | 1.5 | 1.2 | 0.20 | 0.12 | 0.020 | — | — | — | — |
| | 3 | 12.8 | 0.20 | 3.8 | 0.6 | 0.15 | 0.45 | 0.008 | — | — | — | — |
| | 4 | 10.3 | 0.40 | 2.0 | 1.3 | 0.12 | 0.24 | 0.030 | — | — | — | — |
| | 5 | 11.5 | 0.20 | 2.5 | 1.0 | 0.12 | 0.20 | — | 0.07 | — | — | — |
| | 6 | 11.2 | 0.25 | 2.3 | 1.1 | 0.10 | 0.25 | — | 0.28 | — | — | — |
| | 7 | 11.2 | 0.25 | 2.3 | 1.1 | 0.10 | 0.25 | 0.020 | — | 0.20 | — | — |
| | 8 | 11.2 | 0.25 | 2.3 | 1.1 | 0.10 | 0.20 | — | 0.20 | 0.20 | — | — |
| | 9 | 11.6 | 0.25 | 2.4 | 1.0 | 0.12 | 0.23 | 0.020 | — | — | 0.20 | 0.001 |
| | 10 | 11.6 | 0.25 | 2.6 | 1.0 | 0.10 | 0.25 | 0.020 | 0.20 | — | 0.20 | 0.001 |
| | 11 | 11.6 | 0.25 | 2.6 | 1.0 | 0.10 | 0.25 | 0.020 | — | 0.20 | 0.20 | 0.001 |
| | 12 | 11.4 | 0.25 | 2.5 | 1.0 | 0.10 | 0.25 | — | 0.25 | 0.20 | 0.20 | 0.001 |

| Test material | No. | Chemical component (wt %) Mn | Al | Homogenizing heat treatment condition (° C. × hr) | Diameter of equivalent circle (μm) of Si particles | Roundness of Si particles |
|---|---|---|---|---|---|---|
| Example No. of the present invention | 1 | 0.01 | Remainder | 500 × 8 | 2.85 | 0.62 |
| | 2 | 0.03 | Remainder | 520 × 4 | 2.13 | 0.75 |
| | 3 | 0.02 | Remainder | 480 × 12 | 2.95 | 0.52 |
| | 4 | 0.02 | Remainder | 495 × 6 | 2.56 | 0.68 |
| | 5 | 0.02 | Remainder | 520 × 8 | 2.98 | 0.62 |
| | 6 | 0.02 | Remainder | 500 × 8 | 2.84 | 0.65 |
| | 7 | 0.02 | Remainder | 500 × 8 | 2.88 | 0.62 |
| | 8 | 0.02 | Remainder | 500 × 8 | 2.94 | 0.65 |
| | 9 | 0.02 | Remainder | 500 × 8 | 3.06 | 0.70 |
| | 10 | 0.02 | Remainder | 500 × 8 | 2.93 | 0.62 |
| | 11 | 0.02 | Remainder | 500 × 8 | 2.84 | 0.64 |
| | 12 | 0.02 | Remainder | 500 × 8 | 2.76 | 0.58 |

TABLE 2

Evaluation results of mechanical characteristics of quench and age hardened material (T6)

| Test material | No. | Tension test Tensile strength ($N/mm^2$) | Proof stress ($N/mm^2$) | Elongation (%) | High-temperature fatigue test High-temperature fatigue characteristics ($kgf/mm^2$) |
|---|---|---|---|---|---|
| Example No. of the present invention | 1 | 400 | 360 | 8.2 | 21.3 |
| | 2 | 410 | 370 | 7.6 | 19.4 |
| | 3 | 460 | 410 | 6.5 | 22.8 |
| | 4 | 470 | 420 | 6.3 | 20.1 |
| | 5 | 415 | 395 | 8.0 | 19.2 |
| | 6 | 420 | 410 | 7.6 | 19.8 |
| | 7 | 420 | 390 | 7.2 | 19.4 |
| | 8 | 430 | 390 | 7.8 | 19.6 |
| | 9 | 450 | 410 | 6.8 | 19.1 |
| | 10 | 455 | 420 | 6.5 | 20.0 |
| | 11 | 460 | 420 | 6.2 | 20.5 |
| | 12 | 465 | 425 | 7.5 | 20.8 |

TABLE 2-continued

Evaluation results of mechanical characteristics of quench and age hardened material (T6)

| Test material | No. | Charpy test Toughness (kg · $m/cm^2$) | Wear test Wear resistance ($mm^2/kg$) | Flexure test Flexure strength (kgf) | Flexure stroke (mm) | Synthetic evaluation |
|---|---|---|---|---|---|---|
| Example No. of the present invention | 1 | 0.51 | 5.11 | 887 | 25 | Excellent |
| | 2 | 0.50 | 5.26 | 883 | 31 | Excellent |
| | 3 | 0.43 | 4.32 | 901 | 38 | Excellent |
| | 4 | 0.45 | 5.03 | 895 | 37 | Excellent |
| | 5 | 0.47 | 5.18 | 879 | 27 | Excellent |
| | 6 | 0.53 | 5.24 | 884 | 30 | Excellent |
| | 7 | 0.42 | 5.30 | 887 | 32 | Excellent |
| | 8 | 0.47 | 5.10 | 860 | 28 | Excellent |
| | 9 | 0.46 | 4.41 | 910 | 36 | Excellent |
| | 10 | 0.42 | 5.10 | 896 | 34 | Excellent |
| | 11 | 0.45 | 5.20 | 893 | 37 | Excellent |
| | 12 | 0.47 | 5.24 | 880 | 35 | Excellent |

TABLE 3

Evaluation results of mechanical characteristics of quench and age hardened material (T6)

| Test material | No. | Chemical component (wt %) Si | Fe | Cu | Mg | Cr | Ni | Sr | Sb | Zn | Ti | B |
|---|---|---|---|---|---|---|---|---|---|---|---|---|
| Comparative example No. | 13 | 7.0 | 0.30 | 2.3 | 1.1 | 0.12 | 0.20 | 0.020 | — | — | — | — |
| | 14 | 14.0 | 0.30 | 2.3 | 1.1 | 0.12 | 0.20 | 0.020 | — | — | — | — |
| | 15 | 11.5 | 0.60 | 2.3 | 1.1 | 0.12 | 0.20 | 0.020 | — | — | — | — |
| | 16 | 11.5 | 0.30 | 0.5 | 1.1 | 0.12 | 0.20 | 0.020 | — | — | — | — |
| | 17 | 11.5 | 0.30 | 2.5 | 0.2 | 0.12 | 0.20 | 0.020 | — | — | — | — |
| | 18 | 11.5 | 0.30 | 2.5 | 2.0 | 0.12 | 0.20 | 0.020 | — | — | — | — |
| | 19 | 11.5 | 0.30 | 2.5 | 1.1 | 0.60 | 0.20 | 0.020 | — | — | — | — |
| | 20 | 11.5 | 0.30 | 2.5 | 1.1 | 0.10 | 0.60 | 0.020 | — | — | — | — |
| | 21 | 11.5 | 0.15 | 2.1 | 0.8 | 0.15 | 0.18 | 0.020 | — | — | — | — |
| | 22 | 11.5 | 0.25 | 2.3 | 1.1 | 0.10 | 0.20 | 0.020 | — | — | — | — |
| | 23 | 11.5 | 0.25 | 2.3 | 1.1 | 0.10 | 0.20 | 0.020 | — | — | 0.14 | 0.007 |
| | 24 | 11.5 | 0.25 | 2.3 | 1.1 | 0.10 | 0.60 | 0.020 | — | — | 0.10 | 0.005 |

| Test material | No. | Chemical component (wt %) Mn | Al | Homogenizing heat treatment condition (° C. × hr) | Diameter of equivalent circle (μm) of Si particles | Roundness of Si particles |
|---|---|---|---|---|---|---|
| Comparative example No. | 13 | 0.02 | Remainder | 500 × 8 | 2.38 | 0.69 |
| | 14 | 0.02 | Remainder | 500 × 8 | 3.23 | 0.56 |
| | 15 | 0.02 | Remainder | 500 × 8 | 3.08 | 0.62 |
| | 16 | 0.02 | Remainder | 500 × 8 | 3.13 | 0.68 |
| | 17 | 0.02 | Remainder | 500 × 8 | 3.02 | 0.62 |
| | 18 | 0.02 | Remainder | 500 × 8 | 2.85 | 0.56 |
| | 19 | 0.02 | Remainder | 500 × 8 | 3.04 | 0.60 |
| | 20 | 0.02 | Remainder | 500 × 8 | 3.25 | 0.58 |
| | 21 | 0.08 | Remainder | 500 × 8 | 3.91 | 0.35 |
| | 22 | 0.27 | Remainder | 500 × 8 | 5.47 | 0.35 |
| | 23 | 0.02 | Remainder | 500 × 8 | 4.53 | 0.47 |
| | 24 | 0.10 | Remainder | 500 × 8 | 5.27 | 0.43 |

TABLE 4

Evaluation results of mechanical characteristics of quench and age hardened material (T6)

| Test material | No. | Tension test: Tensile strength ($N/mm^2$) | Proof stress ($N/mm^2$) | Elongation (%) | High-temperature fatigue test: High-temperature fatigue characteristics ($kgf/mm^2$) |
|---|---|---|---|---|---|
| Comparative Example No. | 13 | 370 | 320 | 9.5 | 16.5 |
| | 14 | 430 | 390 | 7.1 | 17.3 |
| | 15 | 425 | 380 | 6.3 | 16.3 |
| | 16 | 380 | 340 | 7.8 | 15.8 |
| | 17 | 390 | 345 | 8.0 | 16.3 |
| | 18 | 440 | 420 | 4.5 | 19.8 |
| | 19 | 435 | 395 | 5.3 | 14.7 |
| | 20 | 420 | 390 | 7.2 | 16.5 |
| | 21 | 455 | 420 | 6.5 | 16.2 |
| | 22 | 460 | 420 | 6.2 | 15.3 |
| | 23 | 435 | 395 | 6.4 | 16.8 |
| | 24 | 465 | 425 | 6.8 | 15.8 |

| Test material | No. | Charpy test: Toughness ($kg \cdot m/cm^2$) | Wear test: Wear resistance ($mm^2/kg$) | Flexure test: Flexure strength (kgf) | Flexure stroke (mm) | Synthetic evaluation |
|---|---|---|---|---|---|---|
| Comparative Example No. | 13 | 0.51 | 5.11 | 750 | 20 | Inferior |
| | 14 | 0.38 | 7.23 | 723 | 18 | Inferior |
| | 15 | 0.37 | 6.42 | 753 | 22 | Inferior |
| | 16 | 0.43 | 4.32 | 760 | 20 | Inferior |

TABLE 4-continued

Evaluation results of mechanical characteristics of quench and age hardened material (T6)

| | | | | | |
|---|---|---|---|---|---|
| 17 | 0.47 | 5.18 | 780 | 23 | Inferior |
| 18 | 0.53 | 5.24 | 884 | 30 | Inferior |
| 19 | 0.32 | 5.85 | 738 | 22 | Inferior |
| 20 | 0.38 | 5.30 | 780 | 24 | Inferior |
| 21 | 0.30 | 5.10 | 740 | 22 | Inferior |
| 22 | 0.25 | 5.20 | 630 | 15 | Inferior |
| 23 | 0.35 | 5.20 | 775 | 24 | Inferior |
| 24 | 0.28 | 5.24 | 720 | 20 | Inferior |

All Examples of the present invention (Nos. 1 to 12) shown in Table 1 and Table 2 has well-balanced mechanical characteristics as is apparent from the following data of mechanical characteristics: tensile strength ($N/mm^2$)≧400, proof stress ($N/mm^2$)≧360, elongation (%)≧6.0, high-temperature fatigue characteristics ($Kgf/mm^2$)≧18, toughness ($Kg.m/cm^2$)≧0.40, wear resistance ($mm^2/Kg$)≧4.0, flexure strength (Kgf)≧800, flexure stroke≧25 and "excellent" synthetic evaluation. Therefore, it is apparent that they are wear-resistant wrought Al alloys having excellent fatigue strength, toughness and flexure strength in the state of being subjected to a quench and age hardening heat treatment (T6).

To the contrary, regarding Comparative Examples (Nos. 13 to 24) illustrating a comparison with the present invention, shown in Table 3 and Table 4, desired results are not obtained in any one of mechanical characteristics such as tensile strength, proof stress, elongation, high-temperature fatigue characteristics, toughness, wear resistance, flexure strength and flexure stroke. Therefore, they have not well-balanced mechanical characteristics as is apparent from the "inferior" synthetic evaluation.

Specifically, regarding Comparative Example No. 13, the tensile strength, proof stress and high-temperature fatigue strength are low and desired characteristics can not be obtained. Regarding Comparative Example Nos. 14 and 15, the high-temperature fatigue strength, toughness and flexure strength are low. Regarding Comparative Example Nos. 16 and 17, the high-temperature fatigue strength and flexure strength are low. Regarding Comparative Example No. 18, the elongation is low. Regarding Comparative Example Nos. 19 and 20, the high-temperature fatigue strength and flexure strength are low. Regarding Comparative Example Nos. 21 and 22, desired characteristics can not be obtained because a large amount of Mn is contained and the roundness is low. Regarding Comparative Example Nos. 23 and 24, the high-temperature fatigue strength, toughness and flexure strength are low and desired characteristics can not be obtained.

Next, Examples about the heat treatment condition of the process of the present invention using Test material No. 1 is shown in Table 5. Table 5 illustrate a quench and age hardening heat treatment comprising forging of the present invention, maintaining at 490 to 520° C. for 30 minutes to 4 hours, water quenching and then subjecting to an artificial aging treatment at 170 to 190° C. for 4 to 16 hours.

As shown in Examples (Nos. 25 to 28) of Table 5, those obtained by subjecting to the quench and age hardening treatment after solution treatment have well-balanced mechanical characteristics as is apparent from the "excellent" synthetic evaluation, and the wear-resistant wrought Al alloy having excellent fatigue strength, toughness and flexure strength can be produced.

When other Test materials Nos. 2 to 12 were subjected to the heat treatment according to the present invention in the same condition as described above, the similar results as shown in Table 5 were obtained. The results are excellent and exceed the target values, i.e., tensile strength of 400 N/mm$^2$, proofs stress of 360 N/mm$^2$, elongation of 6.0%, high-temperature fatigue strength of 18 kgf/mm$^2$, Charpy value of 0.40 Kg m/cm$^2$, wear resistance of 4.0 mm$^2$/Kg$^2$, flexture strength of 800 Kgf, and flexture stroke of 25 mm$^2$.

For comparison with the process according to the present invention, a quench and age hardening T6 heat treatment to Test material 1 was conducted after subjecting to a solution treatment without being in the range of the condition of the present invention. The results are shown in Table 5. Regarding those obtained by maintaining at 480° C. for 10 hours, followed by water quenching and further aging at 180° C. for 8 hours, desired characteristics could not be obtained in the tensile strength, proof stress, flexure strength and deflective stroke. Regarding those obtained by subjecting to a heat treatment at 540° C. for 2 hours, grain becomes large and grain boundaries is eutectically molten. Regarding those obtained by maintaining at 505° C. for 2 hours, followed by water quenching and further aging treatment at 170° C. for 2 hours or those obtained by maintaining at 505° C. for 2 hours, followed by water quenching and further aging treatment at 190° C. for 2 hours, desired characteristics could not obtained.

TABLE 5

Evaluation results of mechanical characteristics of quench and age hardened material (T6)

| Test material | No. | Solution treatment (° C. × hr) | Aging condition (° C. × hr) | Crack | Evaluation results of mechanical characteristics of quench and age hardened material (T6) Tension test: Tensile strength (N/mm$^2$) | Proof stress (N/mm$^2$) | Elongation (%) |
|---|---|---|---|---|---|---|---|
| Example No. of the present invention | 25 | 490 × 0.5 | 180 × 8 | None | 400 | 370 | 8.5 |
| | 26 | 520 × 4 | 180 × 8 | None | 415 | 370 | 7.6 |
| | 27 | 505 × 2 | 170 × 4 | None | 405 | 365 | 8.0 |
| | 28 | 505 × 2 | 190 × 16 | None | 420 | 380 | 7.3 |
| Comparative example No. | 29 | 480 × 10 | 180 × 8 | None | 340 | 295 | 9.0 |
| | 30 | 540 × 2 | 180 × 8 | Observed | — | — | — |
| | 31 | 505 × 2 | 170 × 2 | None | 350 | 290 | 8.5 |
| | 32 | 505 × 2 | 190 × 20 | None | 440 | 395 | 6.4 |

| Test material | No. | Evaluation results of mechanical characteristics of quench and age hardened material (T6): High temperature fatigue test: High temperature fatigue characteristics (kgf/mm$^2$) | Charpy test Toughness (kg · m/cm$^2$) | Wear test: Wear resistance (mm$^2$/kg) | Flexural test: Flexure strength (kgf) | Flexure stroke (mm) | Synthetic evaluation |
|---|---|---|---|---|---|---|---|
| Example No. of the present invention | 25 | 18.5 | 0.42 | 4.65 | 865 | 25 | Excellent |
| | 26 | 21.9 | 0.53 | 5.19 | 898 | 28 | Excellent |
| | 27 | 18.0 | 0.55 | 4.41 | 842 | 31 | Excellent |
| | 28 | 22.3 | 0.48 | 5.40 | 910 | 27 | Excellent |
| Comparative example No. | 29 | 17.0 | 0.58 | 4.50 | 680 | 18 | bad |
| | 30 | — | — | — | — | — | — |
| | 31 | 16.5 | 0.54 | 4.92 | 695 | 20 | bad |
| | 32 | 24.3 | 0.52 | 5.10 | 700 | 10 | bad |

EXAMPLE 2

The scroll will be explained by the second Example of the present invention.

Using an alloy having the alloy composition of 11.5% by weight of Si, 0.15% by weight of Fe, 3.43% by weight of Cu, 0.60% by weight of Mg, 0.08% by weight of Cr, 0.01% by weight of Ti, 0.26% by weight of Ni, 0.02% by weight of Sr, 0.01% by weight of Mn and the remainder of Al, an Al alloy ingot having a diameter was produced by a semi-continuous forging method, subjected to a homogenizing treatment at 495±5° C. for 8 hours and then extruded at the extrusion temperature of 420° C. to form an extruded bar having a diameter of 80 mm. Regarding the metallic structure of the extruded bar, Si particles were dispersed and an average diameter of an equivalent circle of Si particles was not more than 5.00 $\mu$m and an average roundness thereof was not less than 0.50.

This extruded bar was subjected to an annealing treatment at 370° C. for 2 hours and then cut to give a disc-shape forging material having a weight of 300 g. A lubricant prepared by containing $MoS_2$ in a normal cold forging oil was applied on this forging material, followed by heating to 280° C.

On the other hand, a $MoS_2$ lubricant was also applied on scroll-shaped dies having a diameter of 80 mm, followed by heating to 145° C. These dies are composed of a lower die and an upper die. The above lubricant was applied on the lower die heated to 145° C. and the heated forging material was put in it. Then, the upper die heated to 120° C. was descended to form a scroll by forging one or more times, e.g., once or twice. In this case, the descending rate (ram descending velocity) of the upper die was 250 mm/second.

Figure 4:
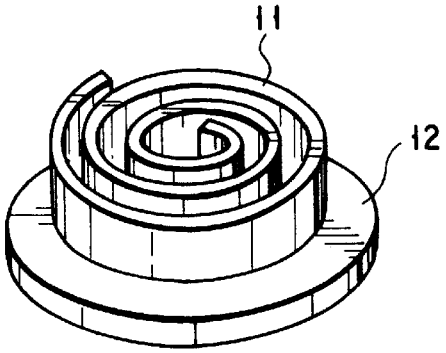
FIG. 4 is a schematic diagram illustrating the form of the scroll.

This scroll as a product has a triple spiral scroll part 11 on one side of a flange 12 having a diameter of 80 mm and a thickness of 10 mm and a boss part (not shown) on the other surface, as shown in FIG. 4. When the scroll was produced by forging once or twice, a product having good dimensional accuracy was obtained. The scroll after forging was maintained at 495±5° C. for 2 hours, followed by water quenching and further quench and age hardening heat treatment (T6) of conducting an artificial aging treatment at 180±5° C. for 8 hours.

The spiral part of the scroll satisfies the following mechanical characteristics even if forging is performed once or twice.

tensile strength: 434±10 N/mm$^2$, proof stress: 385±10 N/mm$^2$, elongation: 6.5±0.5%

Charpy value: 0.47±0.2 K.gm/cm$^2$ flexure strength: 1918±50 kgf, flexure stroke: 1.54±0.15 mm.

Since the flexure tests of the spiral part are carried out to the real sample, it is different from the above mentioned test results performed on JIS Z 2203 using extrusion rod sample.

high-temperature fatigue strength test temperature: 150° C.

rotating rate: 3600 rpm stress: 15.0 Kgf/mm$^2$ (set value)

repeating number: $2.58\times10^7\times(1\pm0.1)$

Therefore, a scroll having high tensile strength, high-temperature wear resistance, fatigue strength at high temperature, toughness and high flexure strength can be obtained and can be stably used for a long period of time.

As explained hereinabove, the wear-resistant wrought Al alloy of the present invention has high strength, high wear resistance, fatigue strength at high temperature, excellent toughness and high flexure strength and has such an industrially remarkable effect that a scroll having high tensile strength, high wear resistance, fatigue strength at high temperature, toughness and high flexure strength can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A wear-resistant wrought Al alloy having excellent high fatigue strength, toughness and flexure strength when subjected to a quenching and an age hardening heat treatment, comprising 10 to 12% by weight of Si, 0.1 to 0.5% by weight of Fe, 2 to 4% by weight of Cu, 0.5% to 1.2% by weight of Mg, 0.05 to 0.3% by weight of Cr, 0.2 to 0.3% by weight of Ni, at least one element selected from the group consisting of 0.01% to 0.03% by weight of Sr and 0.05 to 0.3% by weight of Sb, and the remainder being Al and an unavoidable impurity, an amount of Mn as the unavoidable impurity being controlled to be not more than 0.04% by weight, said Al alloy having Si particles being finely dispersed therein, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)$ (area/(perimeter)$^2$), wherein said area is a surface area of a circle having the same surface area as Si particles and said perimeter is the perimeter of the circle.

2. A wear-resistant wrought Al alloy having excellent high fatigue strength, toughness and flexure strength when subjected to a quenching and an age hardening heat treatment, comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, not more than 0.15% by weight of Zn, at least one element selected from the group consisting of 0.01 to 0.03% by weight of Sr and 0.05 to 0.3% by weight of Sb, and the remainder being Al and an unavoidable impurity, an amount of Mn as the unavoidable impurity being controlled to be not more than 0.04% by weight, said Al alloy having Si particles being finely dispersed therein, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)$ (area/perimeter)$^2$), wherein said area is a surface area of a circle having the same surface area as Si particles and said perimeter is the perimeter of the circle.

3. A wear-resistant wrought Al alloy having excellent high fatigue strength, toughness and flexure strength when subjected to a quenching and an age hardening heat treatment, comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, at least one element selected from the group consisting of 0.01 to 0.03% by weight of Sr and 0.05 to 0.3% by weight of Sb, at least one element selected from the group consisting of not more than 0.08% by weight of Ti and not more than 0.05% by weight of B, and the remainder being Al and an unavoidable impurity, an amount of Mn as the unavoidable impurity being controlled to be not more than 0.04% by weight, said Al alloy having Si particles being finely dispersed therein, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)$ (area/perimeter)$^2$), wherein said area is a surface area of a circle having the same surface area as Si particles and said perimeter is the perimeter of the circle.

4. A wear-resistant wrought Al allay having excellent high fatigue strength, toughness and flexure strength when subjected to a quenching and an age hardening heat treatment, comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, not more than 0.15% by weight of Zn, at least one element selected from the group consisting of 0.01 to 0.03% by weight of Sr and 0.05 to 0.3% by weight of Sb, at least one element selected from the group consisting of not more than 0.08% by weight of Ti and not more than 0.05% by weight of B, and the remainder being Al and an unavoidable impurity, an amount of Mn as the unavoidable impurity being controlled to be not more than 0.04% by weight, said Al alloy having Si particles being finely dispersed therein, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)$ (area/(perimeter)$^2$), wherein said area is a surface area of a circle having the same surface area as Si particles and said perimeter is the perimeter of the circle.

5. A scroll of a wear-resistant wrought Al alloy obtained by:

(a) subjecting an Al alloy ingot to a homogenizing heat treatment at 480 to 540° C. for not less than 2 hours, said Al alloy comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, at least one element selected from the group consisting of 0.01 to 0.03% by weight of Sr and 0.05 to 0.3% by weight of Sb, and the remainder being Al and an unavoidable impurity, an amount of Mn as the unavoidable impurity being controlled to be not more than 0.04% by weight;

(b) hot-extruding or hot-rolling the Al alloy ingot from step (a) for conversion into an Al alloy structure in which Si particles are finely dispersed, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)$ (area/perimeter)$^2$), wherein said area is a surface area of a circle having the same surface area as Si particles and said perimeter is the perimeter of the circle;

(c) forging the hot-extruded or hot-rolled Al alloy from step (b), followed by maintaining the resultant material at 490 to 520° C. for 30 minutes to 4 hours and then carrying out water quenching; and (d) subjecting the resultant material from step (c) to an age hardening heat treatment at 170 to 190° C. for 4 to 16 hours.

6. The scroll according to claim 5, wherein the forging is performed one or more times at a forging die temperature of 120 to 170° C., a material temperature of 220 to 370° C. and a ram descending velocity of 200 to 800 mm/sec, with a cold forging lubricant containing $MoS_2$.

7. A scroll of a wear-resistant wrought Al alloy obtained by:

(a) subjecting an Al alloy ingot to a homogenizing heat treatment at 480 to 540° C. for not less than 2 hours, said Al alloy comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, not more than 0.15% by weight of Zn, at least one element selected from the group consisting of 0.01 to 0.03% by weight of Sr and 0.05 to 0.3% by weight of Sb, and the remainder being Al and an unavoidable impurity, an amount of Mn as the unavoidable impurity being controlled to be not more than 0.04% by weight;

(b) hot-extruding or hot-rolling the Al alloy ingot from step (a) for conversion into an Al alloy structure in which Si particles are finely dispersed, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)$ (area/perimeter)$^2$), wherein said area is a surface area of a circle having the same surface area as Si particles and said perimeter is the perimeter of the circle;

(c) forging the hot-extruded or hot-rolled Al alloy from step (b), followed by maintaining the resultant material at 490 to 520° C. for 30 minutes to 4 hours and then carrying out water quenching; and (d) subjecting the resultant material from step (c) to an age hardening heat treatment at 170 to 190° C. for 4 to 16 hours.

8. The scroll according to claim 7, wherein the forging is performed one or more times at a forging die temperature of 120 to 170° C., a material temperature of 220 to 370° C. and a ram descending velocity of 200 to 800 mm/sec, with a cold forging lubricant containing $MoS_2$.

9. A scroll of a wear-resistant wrought Al alloy obtained by:

(a) subjecting an Al alloy ingot to a homogenizing heat treatment at 480 to 540° C. for not less than 2 hours, said Al alloy comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, at least one element selected from the group consisting of 0.01 to 0.03% by weight of Sr and 0.05 to 0.3% by weight of Sb, at least one element selected from the group consisting of not more than 0.08% by weight of Ti and not more than 0.05% by weight of B, and the remainder being Al and an unavoidable impurity, an amount of Mn as the unavoidable impurity being controlled to be not more than 0.04% by weight;

(b) hot-extruding or hot-rolling the Al alloy ingot from step (a) for conversion into an Al alloy structure in which Si particles are finely dispersed, wherein an average diameter of an equivalent circle of Si particles is not more than 5.00 $\mu$m and an average roundness of Si particles is not less than 0.50, wherein the average diameter of tho equivalent circle is equal to $2\sqrt{(\text{area}/\pi)}$ and the average roundness is equal to $4(\pi)$ (area/perimeter)$^2$), wherein said area is a surface area of a circle having the same surface area as Si particles and said perimeter is the perimeter of the circle;

(c) forging the hot-extruded or hot-rolled Al alloy from step (b), followed by maintaining the resultant material at 490 to 520° C. for 30 minutes to 4 hours and then carrying out water quenching; and (d) subjecting the resultant material from step (c) to an age hardening heat treatment at 170 to 190° C. for 4 to 16 hours.

10. The scroll according to claim 9, wherein the forging is performed one or more times at a forging die temperature of 120 to 170° C., a material temperature of 220 to 370° C. and a ram descending velocity of 200 to 800 mm/sec with a cold forging lubricant containing $MoS_2$.

11. A scroll of a wear-resistant wrought Al alloy obtained by:

(a) subjecting an Al alloy ingot to a homogenizing heat treatment at 480 to 540° C. for not less than 2 hours, said Al alloy comprising 10 to 12% by weight of Si, 0.1 to 0.5% by weight of Fe, 2 to 4% by weight of Cu, 0.5 to 1.2% by weight of Mg, 0.05 to 0.3% by weight of Cr, 0.2 to 0.3% by weight of Ni, not more than 0.15% by weight of Zn, at least one element selected from the group consisting of 0.01 to 0.03% by weight of Sr and 0.05 to 0.3% by weight of Sb, at least one element selected from the group consisting of not more than 0.08% by weight of Ti and not more than 0.05% by weight of B, and the remainder being Al and an unavoidable impurity, an amount of Mn as the unavoidable impurity being controlled to be not more than 0.04% by weight;

(b) hot-extruding or hot-rolling the Al alloy ingot from step (a) for conversion into an Al alloy structure in which Si particles are finely dispersed, wherein an average diameter of an equivalent circle of Si particles is not more than 5.00 $\mu$m and an average roundness of Si particles is not less than 0.50, wherein the average diameter of the equivalent circle is equal to $2\sqrt{(\text{area}/\pi)}$ and the average roundness is equal to $4(\pi)(\text{area}/\text{perimeter})^2)$, wherein said area is a surface area of a circle having the same surface area as Si particles and said perimeter is the perimeter of the circle;

(c) forging the hot-extruded or hot-rolled Al alloy from step (b), followed by maintaining the resultant material at 490 to 520° C. for 30 minutes to 4 hours and then carrying out water quenching; and (d) subjecting the resultant material from step (c) to an age hardening heat treatment at 170 to 190° C. for 4 to 16 hours.

12. The scroll according to claim 11, wherein the forging is performed one or more times at a forging die temperature of 120 to 170° C., a material temperature of 220 to 370° C. and a ram descending velocity of 200 to 800 mm/sec, with a cold forging lubricant containing $MoS_2$.

* * * * *